US005883561A

United States Patent [19]

Nakamura et al.

[11] Patent Number: 5,883,561

[45] Date of Patent: Mar. 16, 1999

[54] SECONDARY SHORT PREVENTING MECHANISM OF FUSE

[75] Inventors: Goro Nakamura; Kenji Muramatsu; Naoki Matsuoka, all of Shizuoka, Japan

[73] Assignee: Yazaki Corporation, Tokyo, Japan

[21] Appl. No.: 974,886

[22] Filed: Nov. 20, 1997

Related U.S. Application Data

[63] Continuation-in-part of Ser. No. 754,139, Nov. 22, 1996, Pat. No. 5,781,094.

[30] Foreign Application Priority Data

Nov. 24, 1995 [JP] Japan ..... 7-305869
Nov. 22, 1996 [JP] Japan ..... 8-312029

[51] Int. Cl.[6] ..... H01H 85/143; H01H 85/153; H01H 85/165; H01H 85/175

[52] U.S. Cl. ..... 337/198; 337/186; 337/187; 337/255; 337/260; 337/159; 337/180; 439/250; 439/622; 439/890

[58] Field of Search ..... 337/186, 159, 337/197, 238, 239, 261, 295, 240, 260, 219, 189, 142, 190, 195, 405, 407, 414, 415, 187, 255, 180; 439/621, 622, 250, 890

[56] References Cited

U.S. PATENT DOCUMENTS 4,871,990 10/1989 Ikeda et al. ..... 337/238
5,186,664 2/1993 Abe ..... 439/845

FOREIGN PATENT DOCUMENTS 64-33146 3/1989 Japan ..... H01H 85/00

*Primary Examiner*—Leo P. Picard
*Assistant Examiner*—Anatoly Vortman
*Attorney, Agent, or Firm*—Sughrue, Mion, Zinn, Macpeak & Seas, PLLC

[57] ABSTRACT

A secondary short preventing mechanism of a fuse is constituted by a pair of female terminal members in which male terminal receiving portions are formed at their longitudinally one ends respectively so that the male terminal receiving portions are to be engaged with and electrically connected to male terminal portions, and a fuse fusing portion is formed between their longitudinally other ends connected to each other; and a housing for housing the female terminal portions, and having a vertically extending insulation partition for horizontally separating the female terminal portions from each other. Each of the male terminal receiving portions has raised pressing contact portions which face each other at different levels, that is, at upper and lower positions in its longitudinal direction, the upper pressing contact portion being projected toward the insulation partition and having elasticity, respectively.

4 Claims, 8 Drawing Sheets

SECONDARY SHORT PREVENTING MECHANISM OF FUSE

This is a C.I.P. of application Ser. No. 08/754,139 Nov. 22, 1996, now U.S. Pat. No. 5,781,094.

BACKGROUND OF THE INVENTION

The present invention relates to a secondary short preventing mechanism of a fuse to be used in an electric circuit of an automobile or the like, and particularly relates to a secondary short preventing mechanism of a fuse which is improved to prevent generation of secondary short of the fuse caused by mutual contact between holding portions for holding a fusing portion after the fusing portion has been fused.

Referring to FIGS. 8, 9 and 10, description will be made as to the schematic configuration of an ordinary fuse to be applied to a connector for connecting a wire harness of an automobile or the like. A fuse 50 is constituted by a fusible link 51 which is formed into a predetermined shape, and an insulation housing 61 in which the fusible link 51 is incorporated and which is to be removably attached onto a high density multielectrode connector (not shown) so as to make terminal connection possible.

The fusible link 51 has a pair of female terminal portions 52 and 52 facing to each other. Lock portions 53 are cut up in the female terminal portions 52 at their not-facing surface sides. Holding portions 54 having relatively narrow widths and extending upward from the not-facing surface sides respectively are bent so as to be connected to each other, and a fusing portion 55 which has a width set narrow correspondingly to a permissible fusing capacity is formed on an intermediate portion of the connection portion.

In order to receive the female terminal portions 52, the housing 61 is partitioned by an insulation partition 64 so as to form a pair of terminal receiving portions 62 and 62 and lock ditches 65 for locking lock portions 53 respectively, at lower-half portion of a space defined by a pair of inner wall surfaces facing each other. Each of the terminal receiving portions 62 has a male terminal insertion opening 63.

Further, a pair of guide ditches 67 and 67 each having a projected end portion formed with a sloping surface 67*a* so as to guide the lock portion 53 in a fusing chamber 66 are formed in the upper-half portion side defined by the inner wall surfaces, and a cover member 68 is fitted on an upper opening 68.

Incorporation of the fusible link 51 into the housing 61 is performed such that the lock portions 53 of the fusible link 51 are pushed, from the upper opening side of the housing 61, along the guide ditches 67 by using a suitable insertion jig or the like so as to incorporate the fusible link 51 into the housing 61. That is, by the thus pushing-in operation, the pair of female terminal portions 52 and 52 are disposed in the corresponding terminal receiving portions 62 with correct postures.

Next, the lock portions 53 are urged and energized inward by the sloping surfaces 67*a* respectively with advance of the insertion operation. Thereafter, at a point of time when the respective female terminal portions 52 have been received in the terminal receiving portions 62, the respective lock portions 53 are recovered from the urged state, and locked in the lock ditches 65 respectively, so that the incorporation is completed.

In the thus configured fuse 50, the respective female terminal portions 52 are fitted, through the insertion openings 63, onto male terminal portions projected in an attachment portion of a high density multielectrode connector (not shown). When an electric current over an allowable value flows in an associated circuit in this state of use, the fusing portion 55 is fused by Joule heat to thereby open the circuit so as to secure the safety of the circuit.

In the case of the foregoing conventional fuse 50, however, there is such a possibility that when the fuse 50 is used in a place such as an automobile or the like where extremely violent vibrations, shocks, or the like are generated, the support portions 54 which have lost support because of fusing of the fusing portion 55 are mutually inclined inside due to the vibrations, shocks, or the like after the fusing portion 55 has been fused as shown in FIG. 10, and the support portions 54 come into contact with each other again in a gap between portions "a" and "b" in FIG. 10. Therefore, the support portions 54 come into contact with each other to thereby generate a secondary short accident.

In order to prevent generation of such a secondary short accident, there has been proposed such a fuse as disclosed in Japanese Utility Model Unexamined Publication No. Sho. 64-33146. In the secondary short preventing structure with respective to this fuse, however, the configuration is relatively complicated and there are problems in reliability and in cost.

SUMMARY OF THE INVENTION

An object of the present invention is to solve the foregoing conventional problems and to provide a secondary short preventing mechanism of a fuse in which generation of a secondary short accident due to mutual contact of holding portions after fusing of a fusing portion can be prevented with a simple structure.

According to a first aspect of the present invention, the above object is attained by a secondary short preventing mechanism of a fuse which comprises: a pair of female terminal members in which male terminal receiving portions are formed at their longitudinally one ends respectively so that the male terminal receiving portions are to be engaged with and electrically connected to male terminals, and a fuse fusing portion is formed at their longitudinally other ends by connecting the longitudinally other ends to each other through a fusible conductor; a housing for housing the female terminal members, the housing having a vertically extending insulation partition for horizontally separating the female terminal members from each other in a loosely fitted state; each of the male terminal receiving portions having raised pressing contact portions which face each other at different levels, that is, at upper and lower positions in its longitudinal direction, the upper pressing contact portion being directed toward the insulation partition, at least one of the upper and lower pressing contact portions having elasticity.

In the secondary short preventing mechanism of a fuse according to the first aspect of the present invention, a male terminal is inserted into the male terminal receiving portion of the housing between the elastic pressing contact portions which are raised in the male terminal receiving portion so as to face to each other at two, upper and lower, positions in the longitudinal direction thereof so that the male terminal is supported at two different levels from the left side and right side by the two raised portions. The male terminal receiving portion is housed in the housing parallelly to the insulation partition of the housing because the upper portion of the male terminal receiving portion is given a force by the raised portions constituting the elastic pressing contact portions so as to rotate outside of the housing. When the fuse fusing portion is fused-off by an overcurrent, a balance between the male terminal receiving portions is lost so that the upper portions of the male terminal receiving portions are pivoted outward by the rotating force to the outside of the housing. As a result, the interval between the fused portions is widened so that it is possible to prevent such a risk that, upon reception of vibrations or the like, the fused portions come into contact with each other again to generate secondary short.

In a preferred embodiment according to the present invention, the upper pressing contact portion is an elastic projection and the lower pressing contact portion is a projection constituted by an elastic spring member. Therefore, the rotary force of the female terminal portions at the time of fusing-off of a fuse increases and further insertion of the male terminal portion is more easily performed.

In another preferred embodiment according to the present invention, the upper pressing contact portion is constituted by a both-side-supported plate spring, and the lower pressing contact portion is constituted by a cantilever plate spring having a lower end portion fixed to the female terminal receiving portion, so that, in addition to the effect of the above-mentioned preferable embodiment, the male terminal can be easily inserted with a small pressing force because the upper end of the lower pressing contact portion extends longitudinally so as to be transformable, and the rotation of the female terminal portions after fusing-off becomes flexible to thereby make it possible to reduce a reaction due to the fusing-off because the elastic biasing force of the female terminal portion is reduced at that time.

The insulation partition of the housing is formed so that its width at its lower portion is made narrower than that at its upper portion to secure a space for making the male terminal receiving portions rotatable at the time of fusing-off of the fuse fusing portion. As a result, when the male terminal receiving portions are pivoted toward the outside, the lower portions of the male terminal receiving portions are pivoted easily toward the inside so that the effect of the mechanism according to the present invention is further increased.

In addition, according to a second aspect of the present invention, the aforementioned object of the present invention can be also attained by a secondary short preventing mechanism of a fuse which comprises: a pair of female terminal members in which male terminal receiving portions are formed at their longitudinally one ends respectively so that the male terminal receiving portions are to be engaged with and electrically connected to male terminals, and a fuse fusing portion is formed at their longitudinally other ends by connecting the longitudinally other ends to each other through a fusible conductor; a housing for housing the female terminal members, the housing having a vertically extending insulation partition for horizontally separating the female terminal members from each other; the insulation partition having cavities formed toward a lower portion of the housing and close to a center axis plane of the housing; each of the male terminal receiving portions having raised pressing contact portions which face each other at different levels, that is, at upper and lower positions in its longitudinal direction; each of the upper pressing contact portions being directed against the insulation partition, and forming a cantilever plate spring with its upper end portion made to be a free end elastically contacting with a slope of the insulation partition so as to be slidable thereon; each of the lower pressing contact portions constituting a contact portion which is formed integrally with the male terminal receiving portion; wherein as soon as the pair of female terminal members are separated from each other when the fuse fusing portion is fused off by heating, the upper pressing contact portions give elastic repulsion force to the male terminals inserted to the male terminal receiving portions so that the male terminal receiving portions as a whole are pivoted toward the slopes of the insulation partition with upper corner portions of the lower pressing contact portions as fulcrum so as to close the cavities.

With this configuration, when the fuse fusing portion is fused off by applying a male terminal overcurrent to the male terminal receiving portions attached to the housing, a tension balance based on elastic forces of the respective upper pressing contact portions acting between the left and right male terminals and the insulation partition and having acted between the male terminal receiving portions is broken. Accordingly, the respective male terminal receiving portions make the upper corner portions of the lower pressing contact portions operate as substantial fulcrum by means of a difference in level from the upper receiving portions, so that the lower ends of the lower pressing contact portions are pivoted to approach each other so as to close the cavity. As a result, the upper fused-off portions are pivoted outward to be separated from each other. Consequently, the distance between the fused-off portions increases. Therefore, when these fused-off end portions suffer vibrations or the like, the left and right male terminal receiving portions are pushed onto the slope of the insulation partition by a large elastic force of the respective upper pressing contact portions, so that such a danger can be avoided more surely that the fused-off end portions come into contact with each other again to thereby generate a secondary short.

According to a preferred embodiment of the present invention having such a configuration, each of the upper pressing contact portions has a mountain-like vertically sectional shape with an apex forming a contact point with the male terminal and at the same time acting as a point of application, while each of the lower pressing contact portions has a trapezoidal vertically sectional shape an upper side of which forms a wide surface to contact with the male terminal under the apex. With this configuration, the male terminals obtain a large contact area near their base portions. Accordingly, the electrical conductivity is improved, and accidents such as heating caused by contact failure, or the like can be avoided.

Further, according to another preferred embodiment, an inner wall of each of the male terminal receiving portions which can be pressed onto the insulation partition is constituted by a double plate formed by folding one fusible conductive metal plate so as to have inside and outside plates, and the upper pressing contact portion is a slender bent portion formed by punching the inside plate of the double plate longitudinally, while an upper end portion which is a free end of the upper pressing contact portion penetrates a notch portion formed in the outside plate and elastically slidably contacts with the slope of the insulation partition. With this configuration, the process of punching can be finished by only once, so that the manufacturing process can be rationalized. In addition, the use material which is comparatively expensive can be saved.

Moreover, according to another preferred embodiment, similarly, the outside plate of the double plate is formed to be an elastic support portion which is a longitudinally punched-out slender bent piece extending substantially in parallel with the upper pressing contact portion, and the free end of the support portion being in contact with the slope of the insulation partition elastically. With such an elastic support portion, the spaced distance between the pair of male terminal receiving portions and the lower end portion of the insulation partition at the not-fusing-off time is ensured. Accordingly, an elastic buffer effect is given to the pivoting of the male terminal receiving portions at the fusing-off time, so that recoiling in response to the pivoting of the respective fusible links fused off is prevented to thereby prevent a secondary short surely.

DETAILED DESCRIPTION OF THE INVENTION

Figure 1:
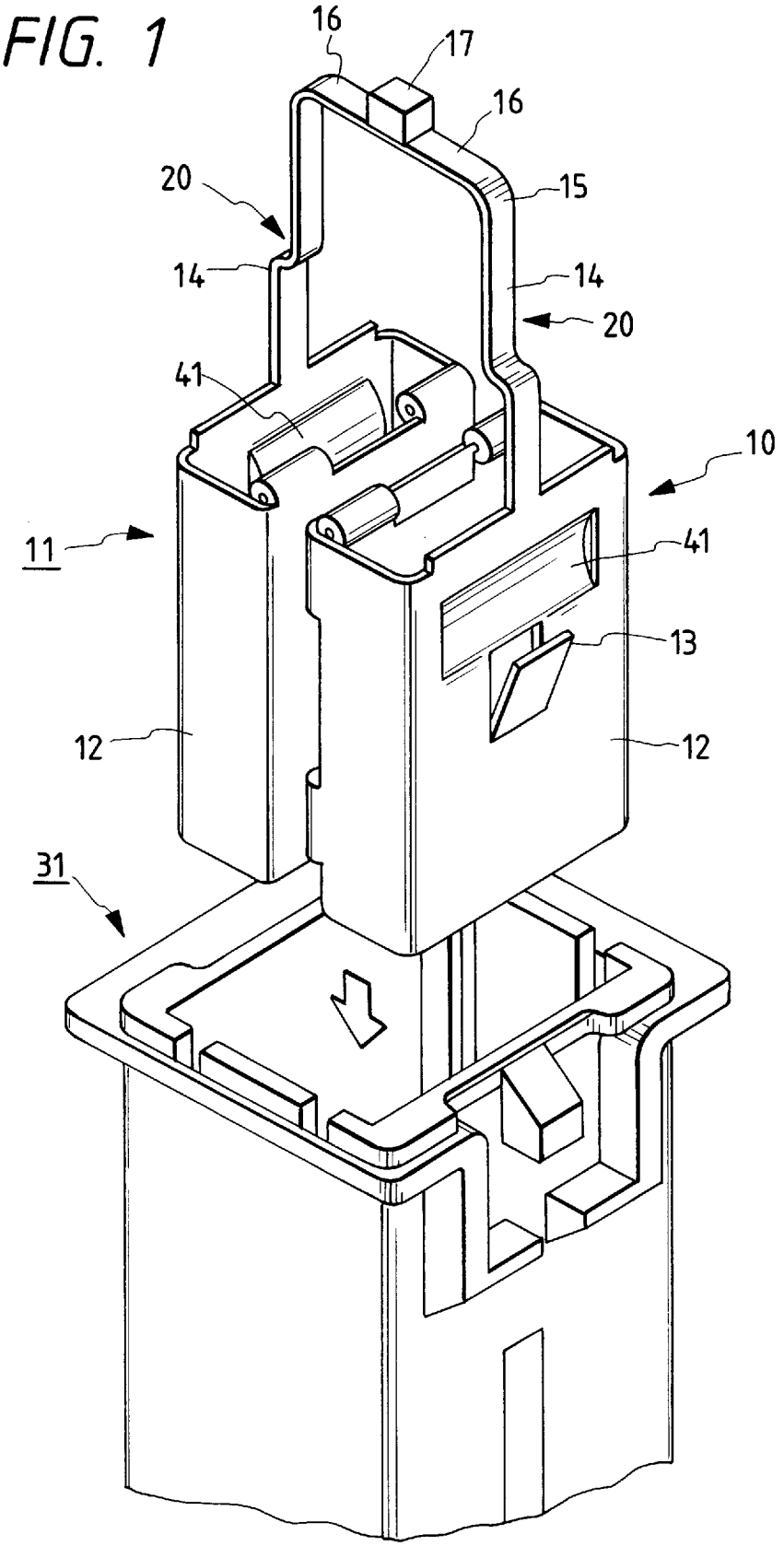
FIG. 1 is a perspective view illustrating an embodiment of a secondary short preventing mechanism of a fuse according to the first aspect of the present invention, showing the schematic configuration of the fuse.
Figure 2:
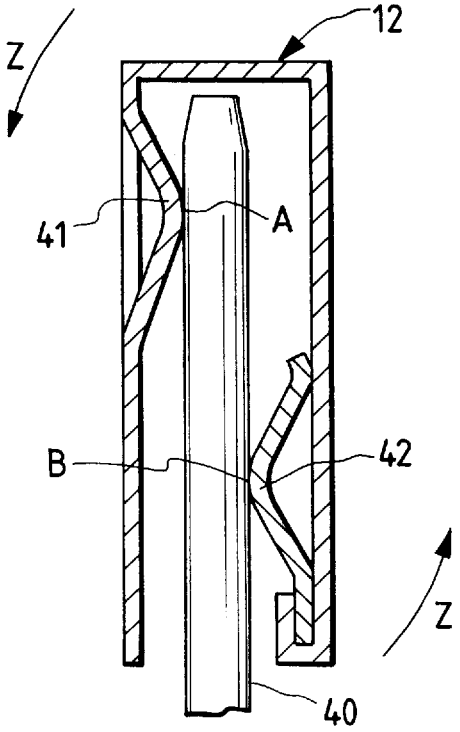
FIG. 2 is an enlarged sectional view showing a part of a male terminal receiving portion of one female terminal portion.
Figure 3:
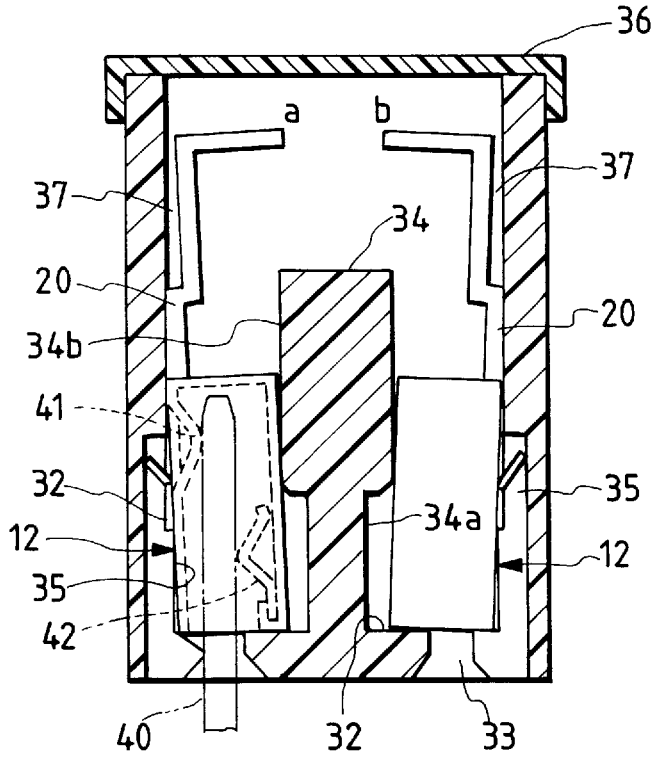
FIG. 3 is a vertically sectional view showing a state where a fusible link is incorporated in a housing in the embodiment of FIG. 1.

Referring to FIGS. 1, 2 and 3, description will be made below about an embodiment of the secondary short preventing mechanism of a fuse according to the first aspect of the present invention. FIG. 1 is a perspective view showing the schematic configuration of a fuse to which the secondary short preventing mechanism according to this embodiment is applied, FIG. 2 is a vertically sectional view showing a male terminal receiving portion constituting the secondary short preventing mechanism, and FIG. 3 is a vertical sectional view showing the fuse of FIG. 1 in the assembled state.

As shown in FIGS. 1 to 3, a fuse 10 according to this embodiment is constituted by a fusible link 11 formed into a predetermined shape, and a housing 31 made of an electrical insulation material such as a plastic substance or the like in which the fusible link 11 is incorporated and which is removably attached to a high density multielectrode connector (only a part of one terminal pin is shown in FIGS. 2 and 3) so that terminal connection can be performed.

The fusible link 11 has a pair of female terminal members 20 and 20 facing to each other, and lock portions 13 are cut up in male terminal receiving portions 12 at their not-facing surface sides.

Further, there is provided holding portions 14 extending upward from the not-facing surface sides of the respective female terminal portions 12. Each of the holding portions 14 is constituted by an upper bent portion 15 bent inward and a top portion 16 extending from the bent portion 15. A gap between the top portions 16 and 16 of the respective holding portions 14 is set to a narrow width corresponding to a fusing capacity, and the top portions 16 and 16 are connected to each other through a fusing portion 17 having a tin chip.

A housing 31 is formed into a rectangular pillar and is partitioned by a vertical insulation partition 34 extending to an upper half portion side of one pair of inner wall surfaces facing to each other in the housing 31 so as to secure a pair of terminal receiving portions 32 which are separated from each other to receive the male terminal receiving portions 12 at the lower half portion side of the pair of inner wall surfaces. Further, as shown in FIG. 3, in each of the pair of terminal receiving portions 32, an insertion opening 33 for inserting a male terminal 40 is formed in a bottom portion of the housing 31 and a lock ditch 35 extending upward from the lower bottom surface is formed so as to make the lock portion 13 lock to a housing inner wall.

In use, as shown in FIG. 2, the male terminal 40 is inserted from the lower end insertion opening 33, firmly fixed on the housing 31 by means of an attachment tool (not shown) such as a socket or a bush, and inserted into the inside of the male terminal receiving portion 12. The male terminal is supported by pressing contact portions 41 and 42 which are raised in opposition to each other in different levels at upper and lower positions within the male terminal receiving portion. A central portion of the pressing contact portion 41 located at the upper portion of the male terminal receiving portion 12 is raised toward the insulation partition 34 extending vertically up. The pressing contact portion 41 is constituted by a both-side-support plate integrally pressed out with a part of the male terminal receiving portion, and, on the other hand, contacts with the surface of the male terminal 40 to which it faces diagonally.

Although it is preferable that the pressing contact portion 41 located at the upper portion has elasticity taking the frictional resistance against insertion of the male terminal into consideration, it is not always particularly necessary to make the pressing contact portion 41 have elasticity because it is sufficient if the pressing contact portion 41 can act as a pivotal fulcrum on the male terminal in operation.

The other pressing contact portion 42 provided a portion lower than the pressing contact portion 41 is constituted by, for example, a cantilever plate spring member having a raised portion and being fixed at its lower end portion on the lower end of the male terminal receiving portion. In this configuration, when the fusing portion 17 is fused, the both-end-supported elastic pressing contact portion 41 and the cantilever plate spring contact portion 42 immediately output force so as to rotate the male terminal receiving portion 12 in the direction Z in FIG. 2, that is, so as to rotate the upper end of the male terminal receiving portion 12 outward in the housing 31, with a point A as a fulcrum and a point B as a point of a level where force is applied.

Upon reception of the foregoing rotary force, the lower end of the male terminal receiving portion 12 moves toward the insulation partition 34 of the housing 31. In order to accept the movement, a lower end 34*a* of the insulation partition 34 is formed to have a diameter smaller than that of an upper end 34*b* so as to secure a space where the lower end of the female terminal member 20 is slightly rotated. Therefore, as viewed from the whole fusible link 11, the rotational movements that both the female terminal members rotate separately in the directions opposite to each other are generated at the same time when the fusing portion is fused. The female terminal members stop in the opened state so that such a fear that the top ends "a" and "b" of the right and left holding portions 14 come into contact with each other is never generated, and as a result secondary short can be prevented from occurring.

In this embodiment, when the fusible link 11 is to be incorporated into the housing 31, the lock portions 13 of the fusible link 11 are inserted from an upper opening side of the housing 31 along guide ditches 37 (FIG. 3) by using a suitable insertion jig or the like. Thereafter, the upper portion of the housing 31 is covered with a cover 36 so as to close the housing 31. At a point of time when the respective male terminal receiving portions 12 have been received in the terminal receiving portions 32 respectively, the lock portions 13 are recovered from the urged state and locked in the lock ditches 35 respectively. The lock portions 13 prevent the fusible link 11 from being pushed-off upward when the male terminal 40 is inserted into the male terminal receiving portions 12 of the female terminal member 20.

The inter-terminal connection using the fuse 10 according to this embodiment will be briefly described. In use, the male terminal receiving portions 12 are connected, through the insertion openings 33, to the male terminals projected into an attachment portion of a high density multielectrode connector (not shown). When an electric current over an allowable value flows in the associated electric circuit in the state of use, the fusing portion 17 is fused by Joule heat to open the circuit so as to secure the safety of the circuit.

Next, another embodiment according to the second aspect of the present invention will be described with reference to FIGS. 4 to 7. Members the same as those used in the above-mentioned embodiment according to the first aspect are referenced by 100 added to their original numbers respectively in order to simplify the description about them.

Figure 4:
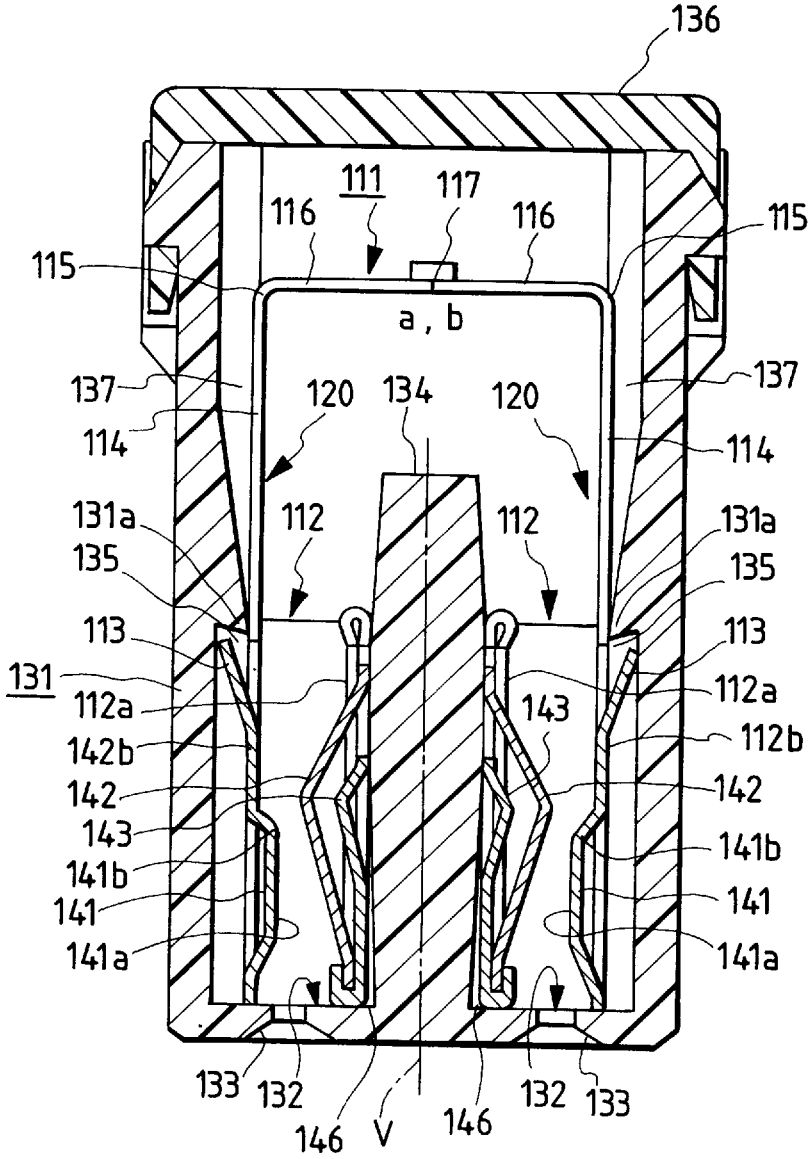
FIG. 4 is a vertically sectional view illustrating an embodiment of a secondary short preventing mechanism of a fuse according to the second aspect of the present invention, showing a state in which a fusible link is incorporated in a housing.
Figure 5:
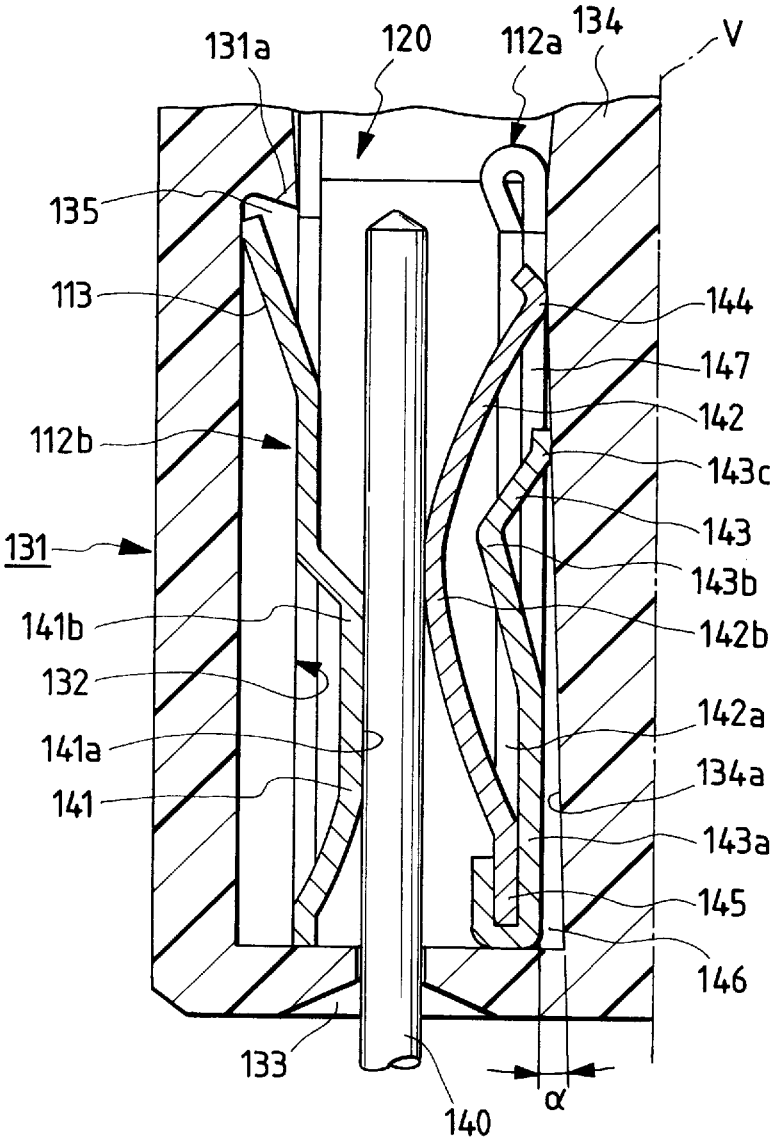
FIG. 5 is a partially vertically sectional view of the secondary short preventing mechanism in FIG. 4, in a normal use state.
Figure 6:
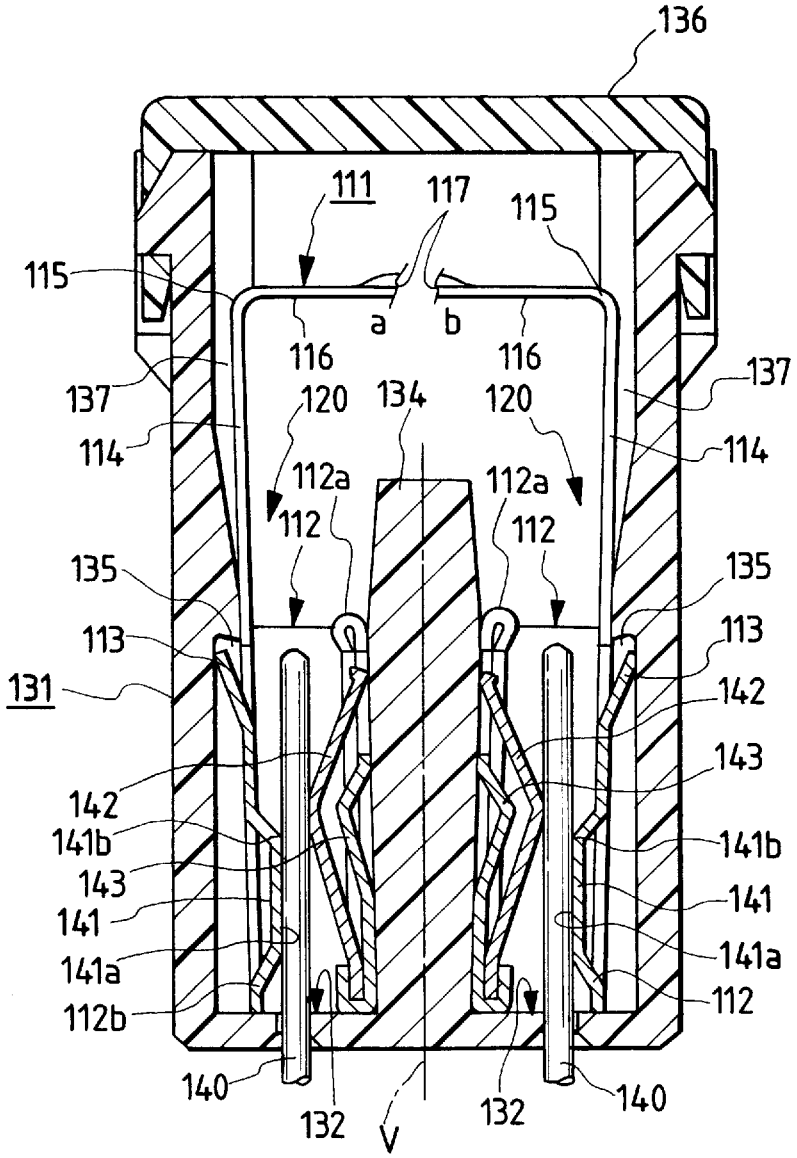
FIG. 6 is a similar view to FIG. 4, showing a state in which the fusible link has been fused off.
Figure 7:
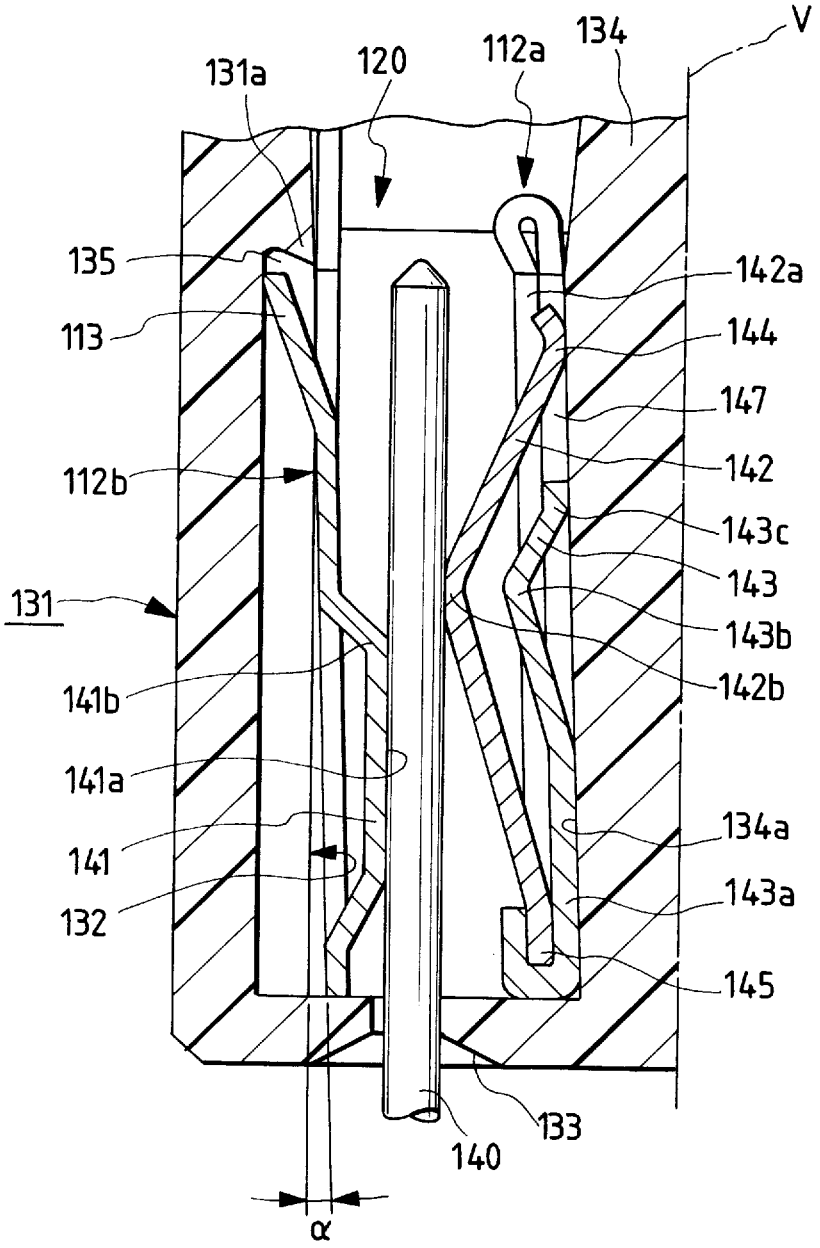
FIG. 7 is a partially enlarged vertically sectional view similar to FIG. 5, showing a state in which a female terminal member in FIG. 6 has been pivoted in the housing.
Figure 8:
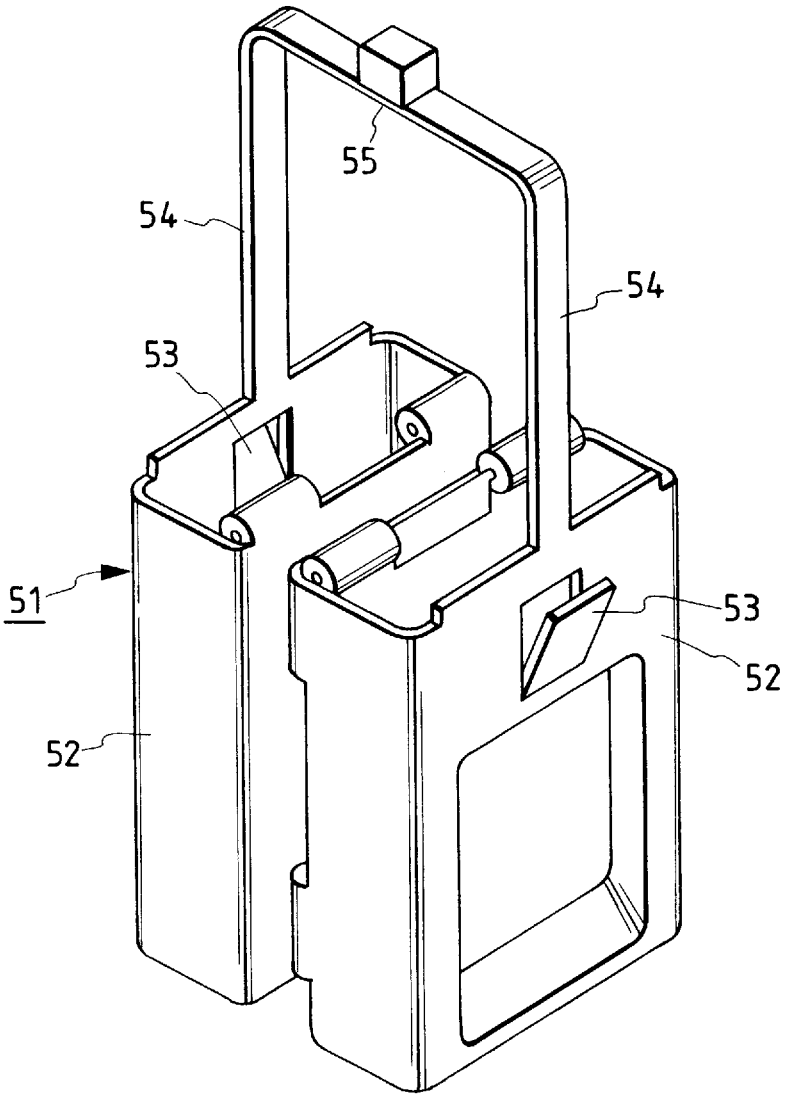
FIG. 8 PRIOR ART
FIG. 8 is a perspective view illustrating a conventional fusible link.
Figure 9:
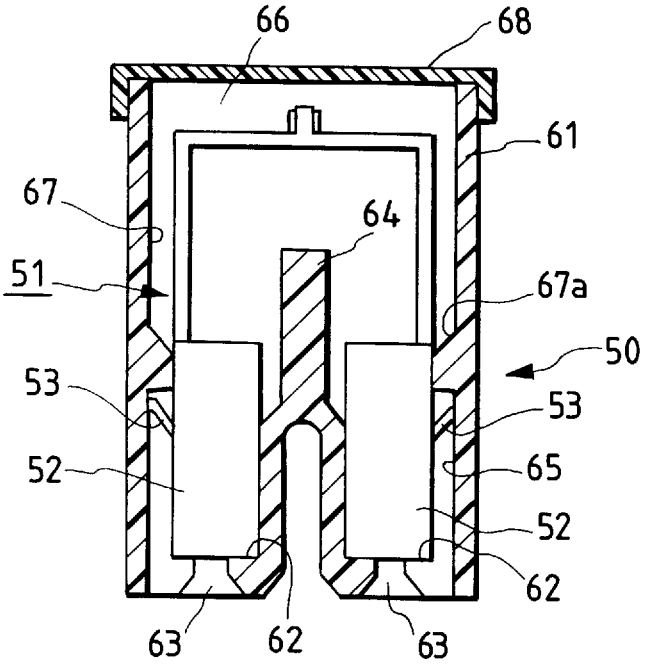
FIG. 9 PRIOR ART
FIG. 9 is a schematic vertically sectional view showing a state in which the conventional fusible link shown in FIG. 8 has been incorporated into a housing.
Figure 10:
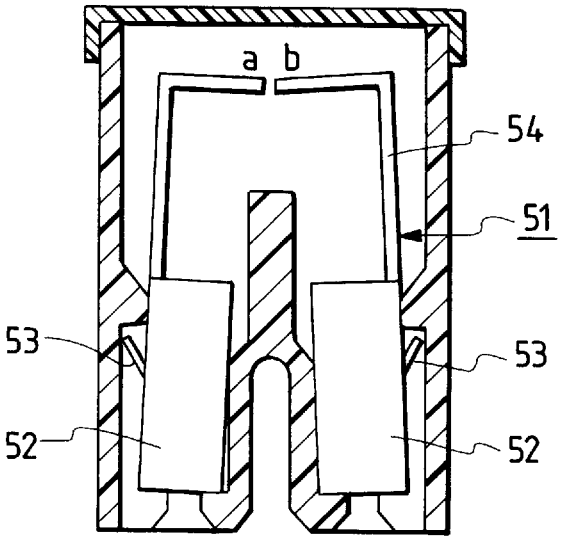
FIG. 10 PRIOR ART
FIG. 10 is a schematic vertically sectional view showing a state in which a fusing portion has been fused in FIG. 8.

FIG. 4 is a vertically sectional view showing a secondary short preventing mechanism of a fuse 110 according to this embodiment, in which a fusible link 111 is incorporated into a housing 131. FIG. 5 is a partially vertically sectional view showing the secondary short preventing mechanism in FIG. 4, showing a normal use state, that is, before fusing-off, in which mechanism a male terminal 140 has been inserted into a female terminal member 120. FIG. 6 is a vertically sectional view showing the secondary short preventing mechanism in FIG. 4 at the time of fuse fusing-off, in which a fusing portion 117 in top portions 116 of fusible link holding portions 114 is separated into two portions "a" and "b". FIG. 7 is a partially enlarged vertically sectional view of the state of FIG. 6, showing the state in which the female terminal member 120 has been pivoted in the housing 131.

FIG. 4 shows the state in which the fusible link 111 is incorporated into the housing 131. The fusible link 111 is punched out from a thermally fusible metal plate to form a U-shape having an upper portion and lower leg portions. The upper portion of the fusible link 111 is constituted by a pair of vertical band-like slender holding portions 114, a pair of horizontal top portions 116 continued to the pair of vertical holding portions 114 through bent portions 115 respectively, and a heating fuse-off portion 117 formed by welding the ends of the horizontal top portions 116 through a tin block. The lower leg portions of the U-shape of the fusible link 111 are constituted by a pair of male terminal receiving portions 112 each of which is bent and formed into a rectangular pillar. The fusible link 11 substantially forms the female terminal members 120 in the present invention.

In addition, FIG. 4 shows the state in which these female terminal members 120 have not received male terminals 140 yet, and the pair of left and right male terminal receiving portions 112 are stored in two terminal receiving portions 132 obtained by partitioning the lower portion in the inside of the housing equally vertically by an insulation partition 134. The fusible link 111 is guided from its upper side by a pair of guide grooves 137 provided in the left and right inner walls of the housing 131 oppositely so as to be positioned in the terminal receiving portions. At that time, lock portions 113 cut up obliquely upward and outward in the upper portions of rectangular outer walls 112*b* of the male terminal receiving portions 112 on which the holding portions 114 are continuously formed in one and the same vertical plane, fit to lock ditches 135 formed in the housing inner walls oppositely and vertically, respectively, and engage with the lower sides of housing projecting edges 131*a* projecting toward the inside of the housing in order to prevent the fusible link 111 from being detached from the housing. Finally, a cover 136 is fitted onto the open upper portion of the housing 131. Then, the assembly is completed.

As for the internal structure of the housing 131, as shown in detail in FIG. 5, a slope 134*a* of the insulation partition 134 extending vertically is formed substantially up to half the height of the housing 131 oppositely to the lock ditches 135. This slope 134*a* is inclined inward with respect to a center axis plane V of the insulation partition 134 so that the thickness of the insulation partition 134 decreases gradually from its center portion toward its lower end portion, so that a cavity 146 the section of which is an acute-angled triangle is formed between the insulation partition 134 and the inner wall 112*a* of the male terminal receiving portion 112 facing the insulation partition 134 directly. The apical angle $\alpha$ of this cavity 146 is shown by the arrow in FIGS. 5 and 7. This apical angle $\alpha$, which will be described in detail later, is the same as a pivoting angle of the female terminal members 120 when they are separated horizontally from each other and pivoted in opposite directions respectively at the time of fuse fusing-off.

Next, the configuration and operation of the male terminal receiving portions 112 of the female terminal members 120 will be described with reference to FIGS. 5 and 7. Each of the male terminal receiving portions 112 has raised pressing contact portions 142 and 141 which face each other at different levels, that is, at its upper and lower positions in its longitudinal direction. The upper pressing contact portion 142 is projected in the direction against the insulation partition 134, and constituted by a slender plate spring which forms a single point contact with a male terminal 140 inserted through an insertion opening 133 of the housing 131 and which has a mountain-like vertically sectional shape with an apex portion 142*b* functioning as a point of application at the time of pivoting. Further, an upper end portion 144 of the upper pressing contact portion 142 forms a free end which elastically contacts with the slope 134*a* of the insulation partition slidably, while an lower end portion 145 of the same is fixed to the inner wall 112*a* of the male terminal receiving portion 112 so as to form a contact portion with the male terminal.

The lower pressing contact portion 141 has a trapezoidal vertically sectional shape the upper side of which forms a longitudinally extending large contact surface 141*a* with the male terminal 140 in the portion lower than the apex 142*b* of the upper pressing contact portion 142, and the lower pressing contact portion 141 is formed integrally with the outer wall 112*b* of the male terminal receiving portion 112 so as to contact with the base portion of the inserted male terminal 140 in the longitudinally extending large contact surface 141*a*.

As soon as the pair of female terminal members 120 are separated from each other by fusing-off of the fuse fusing portion 117 caused by heating, the elastic force of the lower pressing contact portion 141 acting on the male terminal 140 is released slightly, and at the same time the upper pressing contact portion 142 gives an elastic repulsion force to the upper portion of the male terminal 140. Consequently, the contact portion as a whole is pivoted all over the apex of the acute-angled triangle forming the cavity 146 on an upper corner portion 141*b* of the lower pressing contact portion 141 as fulcrum so that the male terminal receiving portion 112 as a whole is pressed onto the slope 134*a* of the partition 134. As a result, the male terminal receiving portions are pivoted so that their lower ends approach each other, while the upper fusing portions are rotated outward to be separated away from each other.

By this operation, the distance a-b between the fusing portions fused off is increased. Therefore, when these fused-off end portions suffer vibrations or the like, the left and right male terminal receiving portions 112 are pressed onto the slope 134*a* of the insulation partition 134 by the elastic force of the respective upper pressing contact portions 142, so that it is possible to prevent such a danger more surely that the fused-off end portions "a" and "b" come into contact with each other again to thereby generate a secondary short.

Since the male terminals 140 obtain a large elastic area to contact with the lower pressing contact portions 141 near the base portions of the male terminals, the electrical conductivity is improved and accidents such as heating caused by contact failure or the like can be avoided. In addition to such superior contact holding properties, each of the upper pressing contact portions has a mountain-like vertically sectional shape, so that the point of application to the male terminal surface is concentrated in one point. Therefore, flexible repulsive elasticity can be obtained in the upper pressing contact portions so as to prevent re-contact due to secondary vibrations caused by an excessive repulsion force.

In addition, the inner wall 112*a* of the male terminal receiving portion 112 which can be pressed onto the insulation partition 134 is constituted by a double plate formed by folding a fusible conductive metal plate, and the upper pressing contact portion 142 is constituted by a slender bent portion formed by longitudinally punching the inside plate 142*a* of the double plate. The upper end portion 144 which is a free end penetrates a notch portion 147 provided in an outside plate 143*a* so as to elastically slidably contact with the slope 134*a* of the insulation partition 134.

Further, the outside plate 143*a* folded so as to face-to-face contact with the inside plate 142*a* has a longitudinally punched-out elastic support portion 143 constituted by a slender bent portion. The elastic support portion 143 extends substantially parallelly to the pressing contact portion 142, and has an apex portion 143*b* corresponding to the apex portion 142*b*. A free end 143*c* of the elastic support portion 143 elastically contacts with the slope 134*a* of the insulation partition 134 in the same manner as described above. Therefore, this elastic support portion 143 not only equally ensures the spaced distances between the pair of male terminal receiving portions 112 and the insulation partition 134 before fuse fusing-off, but also cooperates with the lower pressing contact portion 141 so as to give an elastic biasing force to the slope 134*a* against the pivoting of the upper pressing contact portion 142. However, the biasing force is not large enough to overcome the elastic repulsion force of the upper pressing contact portion, but it is large enough to have a buffer function to prevent the respective fusible links 116 from recoiling at the time of fuse fusing-off so as to bring the fused-off portions into a secondary short.

With this configuration, in manufacturing such a fusible link 111, the process of punching can be achieved by only one step. Accordingly, the manufacturing process can be rationalized, and use of comparatively expensive material can be saved.

Since the secondary short preventing mechanism of a fuse according to the first and second aspects of the present invention has such a configuration as described above, there is such an effect that the respective upper ends of the female terminal members rotate outward to make the holding portions pivot away from each other smoothly after the fusing portion is fused so that a secondary short accident due to mutual contact of the fused holding portions is surely prevented from occurring with a simple structure with which a fusible link can be manufactured only by a simple process of sheet metal working without providing any special separating means for making the fused portions separate from each other.

What is claimed is:

1. A secondary short preventing mechanism of a fuse comprising:

a pair of female terminal members in which male terminal receiving portions are formed at their longitudinally one ends respectively so that said male terminal receiving portions are to be engaged with and electrically connected to male terminals, and a fuse fusing portion is formed at their longitudinally other ends by connecting said longitudinally other ends to each other through a fusible conductor; and a housing for housing said female terminal members, said housing having a vertically extending insulation partition for horizontally separating said female terminal members from each other;

wherein said insulation partition has cavities formed toward a lower portion of said housing and close to a center axis plane of said housing;

wherein each of said male terminal receiving portions has raised pressing contact portions which face each other at different levels of upper and lower positions in its longitudinal direction;

wherein each of said upper pressing contact portions is directed away from said insulation partition, and forms a cantilever plate spring with its upper end portion made to be a free end elastically contacting with a slope of said insulation partition so as to be slidable thereon;

wherein each of said lower pressing contact portions constitutes a contact portion which is formed integrally with said male terminal receiving portion; and wherein as soon as said pair of female terminal members are separated from each other when said fuse fusing portion is fused off by heating, said upper pressing contact portions give elastic repulsion force to said male terminals inserted to said male terminal receiving portions so that said male terminal receiving portions as a whole are pivoted toward said slopes of said insulation partition with upper corner portions of said lower pressing contact portions as fulcrum so as to close said cavities.

2. A secondary short preventing mechanism of a fuse according to claim 1, wherein each of said upper pressing contact portions has a mountain-like vertically sectional shape with an apex forming a contact point with said male terminal and at the same time acting as a point of application, while each of said lower pressing contact portions has a trapezoidal vertically sectional shape an upper side of which forms a wide surface to contact with said male terminal under said apex.

3. A secondary short preventing mechanism of a fuse according to claim 1, wherein an inner wall of each of said male terminal receiving portions which can be pressed onto said insulation partition is constituted by a double plate formed by folding one fusible conductive metal plate so as to have inside and outside plates, and said upper pressing contact portion is a slender bent portion formed by punching an inside plate of said double plate longitudinally, while an upper end portion which is a free end of said upper pressing contact portion penetrates a notch portion formed in an outside plate of said double plate and elastically slidably contacts with said slope of said insulation partition.

4. A secondary short preventing mechanism of a fuse according to claim 3, wherein said outside plate of said double plate has an elastic support portion which is a longitudinally punched-out slender bent piece extending substantially in parallel with said upper pressing contact portion, and wherein a free end of said elastic support portion is in contact with the slope of said insulation partition elastically.

* * * * *